US011890523B2

(12) United States Patent
Tartuffe et al.

(10) Patent No.: US 11,890,523 B2
(45) Date of Patent: Feb. 6, 2024

(54) PROXIMITY TRAINING DEVICE

(71) Applicants: Destinee L. Tartuffe, Santa Rosa, CA (US); Alana A. Vilagi, Bellingham, WA (US)

(72) Inventors: Destinee L. Tartuffe, Santa Rosa, CA (US); Alana A. Vilagi, Bellingham, WA (US)

( * ) Notice: Subject to any disclaimer, the term of this patent is extended or adjusted under 35 U.S.C. 154(b) by 0 days.

(21) Appl. No.: 17/359,597

(22) Filed: Jun. 27, 2021

(65) Prior Publication Data

US 2021/0402277 A1 Dec. 30, 2021

Related U.S. Application Data

(60) Provisional application No. 63/045,336, filed on Jun. 29, 2020.

(51) Int. Cl.
*A63B 69/20* (2006.01)
*A63B 69/22* (2006.01)

(52) U.S. Cl.
CPC ..... *A63B 69/20* (2013.01); *A63B 69/215* (2022.08); *A63B 69/222* (2022.08); *A63B 2209/00* (2013.01); *A63B 2244/10* (2013.01)

(58) Field of Classification Search
CPC ..... A63B 69/20; A63B 69/215; A63B 69/22; A63B 69/222; A63B 69/28; A63B 69/30; A63B 2209/00; A63B 2240/10
See application file for complete search history.

(56) References Cited

U.S. PATENT DOCUMENTS 3,421,759 A 1/1969 Chambers
4,088,315 A 5/1978 Schemmel
(Continued)

FOREIGN PATENT DOCUMENTS

BR PI1102688 B1 6/2011
EA 25405 B1 12/2016
(Continued)

OTHER PUBLICATIONS

Ceren Suveren-Erdogan & Sibel Suveren, Teaching of Basic Posture Skills in Visually Impaired Individuals and Its Implementation Under Aggravated Conditions, Journal of Education and Learning, 2018, pp. 109-116, vol. 7, No. 3, Published by Canadian Center of Science and Education.

*Primary Examiner* — Megan Anderson
(74) *Attorney, Agent, or Firm* — My Patent Guys; Christopher Pilling

(57) ABSTRACT

A proximity training device for use in training of activities (FIG. 3), that anybody can use whether they are a beginner, intermediate, or advanced activity enthusiast (user) participating in martial arts or another partner-oriented activities. The user is able to utilize the training device safely allowing them to maintain their physical fitness activities. The user engages the training device maintaining an upright posture and initiates movement thereby activating the training device. It is held within the same proximity of an in-person training partner, allowing the user to practice the fundamental biomechanical responses and other skills required for their preferred chosen activities. The training device is lightweight and easy to store. The arms are easily removed and are adjustable for optimizing user comfort and training device functionality. The training device is easy to assemble and disassemble which allows for easy transport and storage of the training device.

9 Claims, 13 Drawing Sheets

(56) References Cited

U.S. PATENT DOCUMENTS

| | | | | |
|---|---|---|---|---|
| 4,998,719 | A | 3/1991 | Jahoda | |
| 5,697,872 | A * | 12/1997 | Stronsick, Jr. | A63B 69/20 482/90 |
| 5,800,319 | A * | 9/1998 | Choate | A63B 69/20 482/83 |
| 8,029,421 | B2 * | 10/2011 | Commeau | A63B 69/222 482/89 |
| 11,602,681 | B1 * | 3/2023 | Hammett | A63B 69/215 |
| 2014/0221172 | A1 * | 8/2014 | Siklosi | A63B 69/22 482/90 |
| 2015/0099611 | A1 * | 4/2015 | Lyman | A63B 69/26 482/83 |
| 2017/3337775 | | 11/2017 | Sarkees | |
| 2019/0143189 | A1 * | 5/2019 | Elmore | A63B 69/24 473/438 |
| 2021/0402276 | A1 * | 12/2021 | Peyton | A63B 69/30 |

FOREIGN PATENT DOCUMENTS

| | | | |
|---|---|---|---|
| JP | 319575 | B1 | 1/2015 |
| KR | 1020110028690 | B1 | 3/2011 |
| RU | 119627 | B1 | 8/2012 |
| WO | 2013084012 | B1 | 6/2013 |

* cited by examiner

13

PROXIMITY TRAINING DEVICE

CROSS-REFERENCE TO RELATED APPLICATIONS

This application claims the benefit of provisional U.S. patent application Ser. No. 63\045,336, filed Jun. 29, 2020 by the present inventors, which is incorporated by reference in its entirety.

FEDERALLY SPONSORED RESEARCH

Nonapplicable.

SEQUENCE LISTING OR PROGRAM

Nonapplicable.

BACKGROUND

Field of Invention

The invention, a proximity training device or training device, for use in training of activities, relates to the field of movement exercises within the scope of activities that may be performed individually or with a partner for example: sports, such as martial arts and dance. The invention also relates to the fields of education and medical rehabilitation applications.

Background

Prior Art

Current training devices existing for users to practice their preferred activities are limited in their applicability for an at-home user. For example many of the training devices, commonly known as training dummies, available for martial arts training applications include dummies that are heavy and awkward to maneuver. They are best utilized for users who are training for higher level competitive purposes, and under the direct supervision of an instructor. Use of these types of training dummies may cause injury to person or property if the user is not instructed in the proper and appropriate use of the training dummy. Additionally, the current training dummies are typically filled with a material that over time and repeated use will leak resulting in a training dummy that is no longer fulfilling its purpose. Some other training dummies require that the user stuff the training dummy themselves, this leads to a training dummy that may not be balanced properly and will lead to the user to develop bad posture and technique, ultimately resulting in injury to the user.

Additional prior art research revealed training devices that are limited in scope addressing only one aspect of an activity. For example a training device for Judo that focuses only on ASHI-WAZA skills, or dance training accessories that focus on developing only some of the essential fundamental biomechanical functions of movement. Other training dummies specifically tailored to grappling applications.

Overall, existing training dummies were developed as supplemental training devices to in-person instruction and are not suitable for an at-home user.

SUMMARY

The invention is based on a need for users to social distance from one another for health and safety concerns. A need to social distance has disrupted entire fields of social activities for those users who rely on movement activities for fitness of mind, body, and spirit. Including users who participate in dance and martial arts activities. The invention allows the user to continue practicing and developing the fundamental biomechanical responses necessary to reduce risk of injury by allowing the user to focus on and repeatedly practice proper posture and application of a technique. This is accomplished by utilizing slow-controlled movements that have real-time effect on the ability of the brain to program the biomechanical responses essential to the mind body response connection. Human movement is a complicated biomechanical sequence. Repeated practice of incorrect biomechanical sequencing will ultimately lead users to injury because of poorly established biomechanical response timing.

Accordingly, these and related objects are accomplished by a training device, which includes: a training device, according to the invention, because of its shape and material, offering the minimal resistance for carrying out movement exercises in a slow and controlled manner by the user, and furthermore, has a relatively low weight, not exceeding four pounds for the basic model, its shape is approximately that of a human spine with appendages resembling the shape of human arms and human foot or human legs and feet attached and therefore, a real representation of the foot or feet of a partner, which simulates the proximity of a partner in a user's chosen activity. This is highly desirable since exercising with the device is anticipated to be followed by actual training with an in-person partner when the circumstances allow the user to return to their preferred activity being performed in its normal setting.

Currently, there is no invention that has been identified by the inventors which addresses the need of persons who participate in partner-oriented movement activities that focus on the development of the fundamental biomechanical movement responses while practicing solo and without an in-person partner or instructor.

These and other objects and advantages of the invention will become apparent from the following description of the accompanying drawings, which disclose several embodiments of the training device invention. It is to be understood that the drawings are to be used for the purposes of illustration only, and not as a definition of the invention.

DETAILED DESCRIPTION

Figure 3:
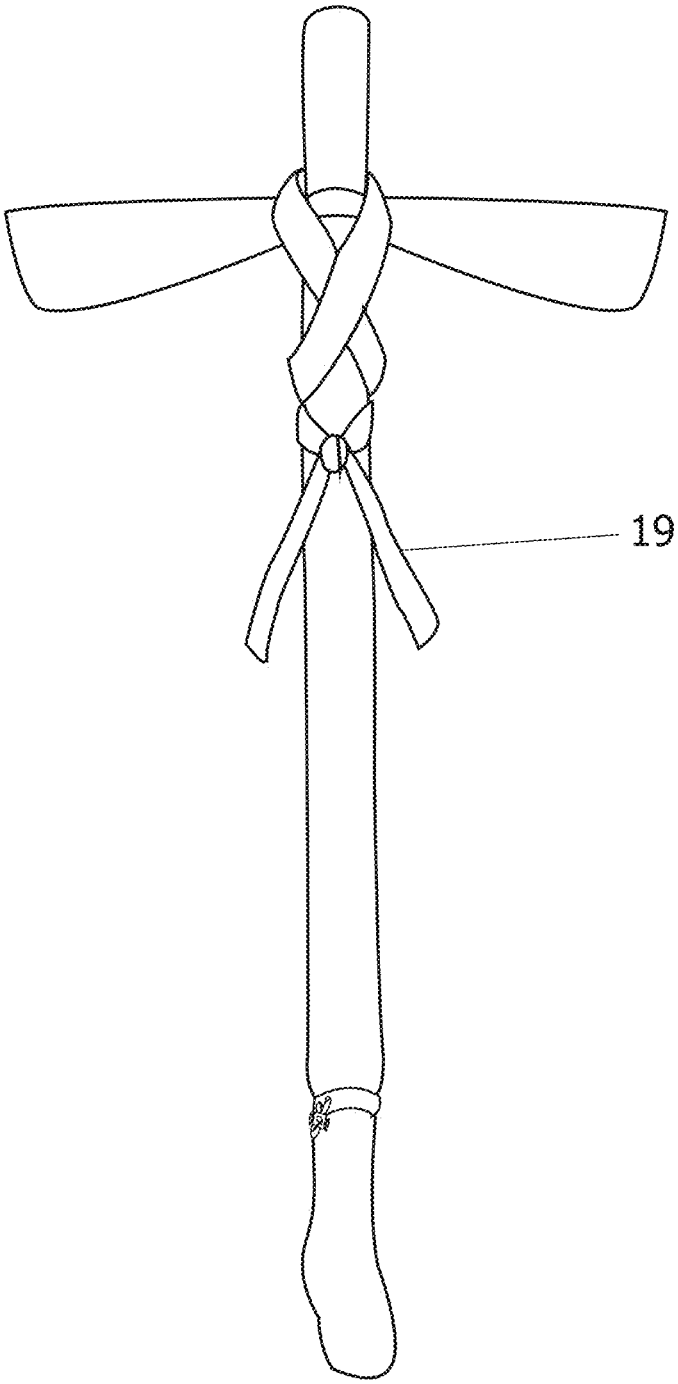
FIG. 3 is a frontal view of a training device, according to the invention, showing a complete assembled first embodiment of the training device.
Figure 4:
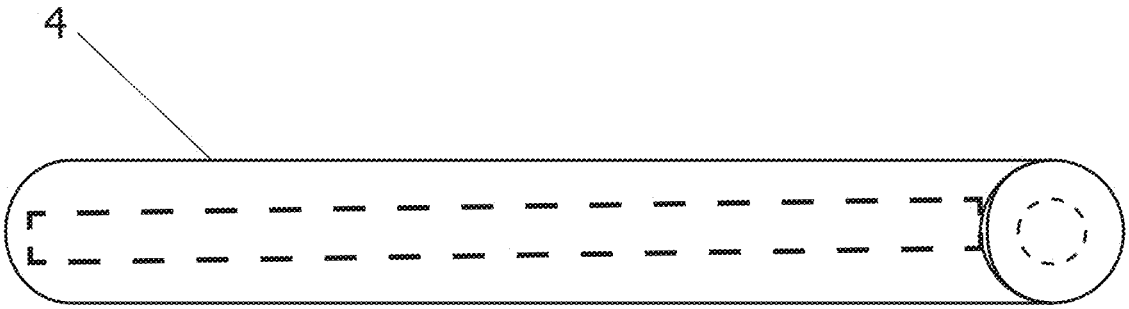
FIG. 4 is a perspective view showing a foam noodle with material for stabilizing training device spinal integrity indicated by dotted lines.
Figure 5:
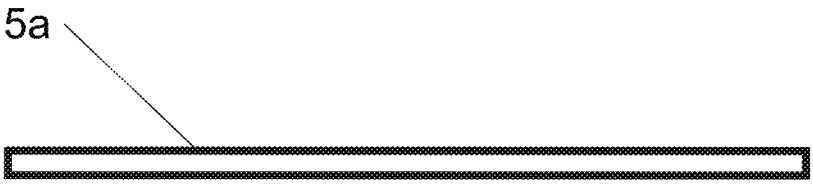
FIG. 5 is a perspective view illustrating an elongated support member, according to the invention, used for connecting means and stabilization of training device spine.
Figure 6:
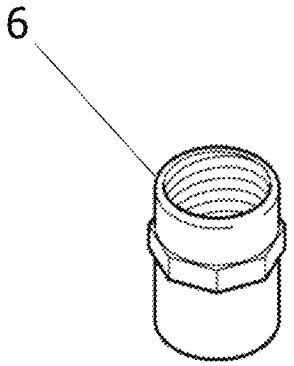
FIG. 6 is a perspective view illustrating a female connector for connecting the plurality of parts.
Figure 7:
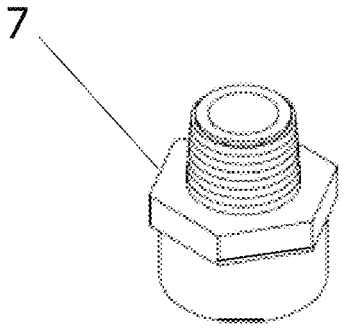
FIG. 7 is a perspective view illustrating a male connector for connecting the plurality of parts.
Figure 8:
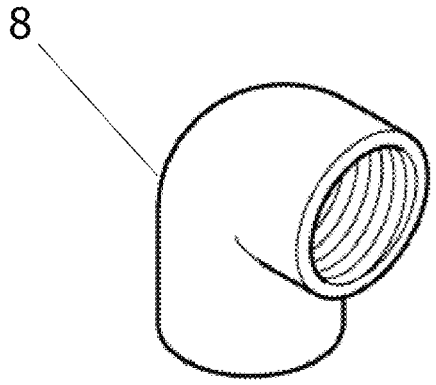
FIG. 8 is a perspective view illustrating a 90 degree elbow (8) for connecting the plurality of parts.
Figure 9:
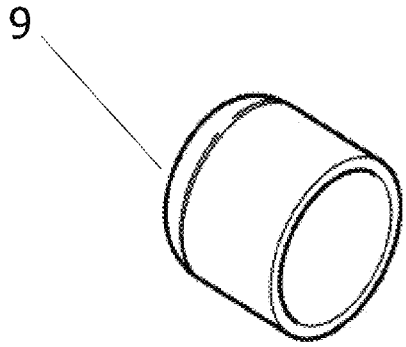
FIG. 9 is a perspective view illustrating cap (9) for connecting the plurality of parts.
Figure 10:
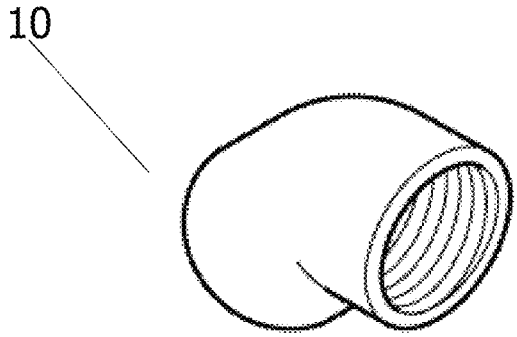
FIG. 10 is a perspective view illustrating a 45 degree elbow (10) for connecting the plurality of parts.
Figure 11:
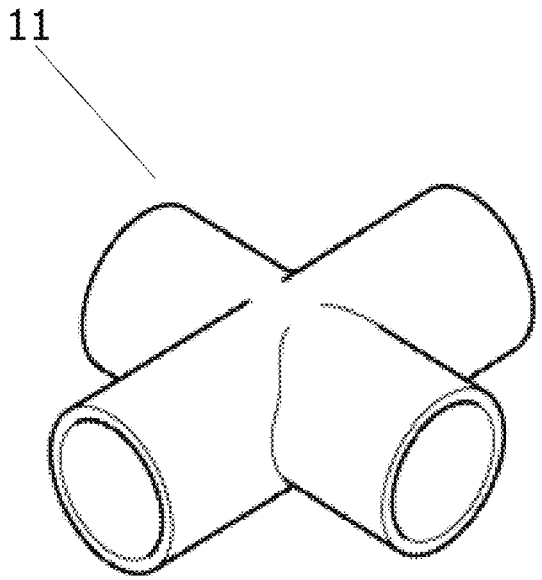
FIG. 11 is a perspective view illustration a cross fitting (11) for connecting the plurality of parts.
Figure 12:
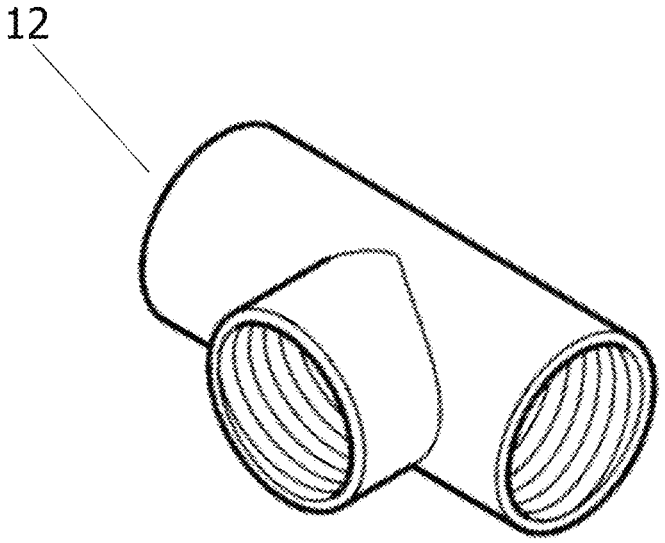
FIG. 12 is a perspective view illustrating a 3-way tee (12) for connecting the plurality of parts.

Referring to the FIG. 3, there is shown a training device comprising a plurality of resilient members that are connected to one another, comprised of a generally cylindrical-shaped training device spine comprised of an elongated, polyethylene foam noodle (4), with a stabilizing, yet flexible center (5), with an attached training device foot (14) comprised of, variable-density self-skinning polyurethane expanding foam, attached at the lower end of the cylindrical-shaped training device spine.

The training device has training device arms (18) comprised of variable-density, self-skinning polyurethane expanding foam. Said training device arms are inserted into an arm cover (17) and then attached to the training device spine (FIG. 3) with means of attachment being fabric ties to this means of attachment (not depicted.)

Additionally, means (not depicted) may be attached to allow for suspension of the unit from a frame-type structure (not depicted) with rubber band attachments for repeated speed-entry training, and light resistance training, such frame-type structure or rubber band attachments.

The training device in FIG. 3 has a multiple piece removable cover comprised of a material which is durable and easily cleaned or replaced, preferably constructed of a rip-stop nylon or canvas-type material. The training device spine cover is much like a long stocking which fits over the top of the training device spine. The cover is then pulled over the top end of the training device spine and secured by a drawstring closure system (16*a*). The training device arms (18) have a separate arm cover (17) designed for ease of guiding and using the training device.

The arm covering has means for attachment (17) to the training device spine (FIG. 3) being, fabric ties. There is a separate collar (19) that loops around the training device spine (19*a*) which functions as supplemental control of the training device by the user (not depicted.) The foot (14) is covered with a stocking like material such as nylon (15), it is not permanently attached and is easily replaceable.

As shown in 14 the bottom part of the training device is shaped in a form resembling a human foot having a flatter outer edge and conforming to the instep and front of the foot. A curved part having a smaller radius tapering inwardly and outwardly conforming to the transition from the training device foot to the training device spine (FIG. 3) and finally a rounded heel are also provided. In the simulated design of the average human foot the bevel of sourced slope in the ascending part simulates the instep of a human foot. The training device foot is sized to simulate the average human foot for adult, teen and child versions.

Furthermore, the training device shown in FIG. 3, which represents a completely assembled first embodiment may be manufactured by other methods which would allow for the production of a volume of units while keeping the device affordable.

Means for attachment and connection of additional weighted material may be placed in the training device foot 14 near the toe area and near the heel area. (Means for attachment not depicted.) Additional weighted material (not depicted) may also be placed in the arm attachment area of the spine the weighted material may be added in a number of manners, including the following: insertion of weighted material in the tube of the training device spine (4), insertion of weighted material in training device arms (18).

Weight may also be inserted in the hollow spaces which are not depicted in the drawings. The weighted material functions to increase the frictional resistance and the force that may be applied by the user for the given movement of the preferred user activity.

Said training device has a symmetrical, cylindrically-shaped training device spine (FIG. 3). Said training device offers identical training or exercising possibilities from any side irrespective of its position, which is important particularly for developing the fundamental biomechanical responses associated with chosen activities, which require and promote balanced and coordinated responses between the mind and the body.

Figure 1:
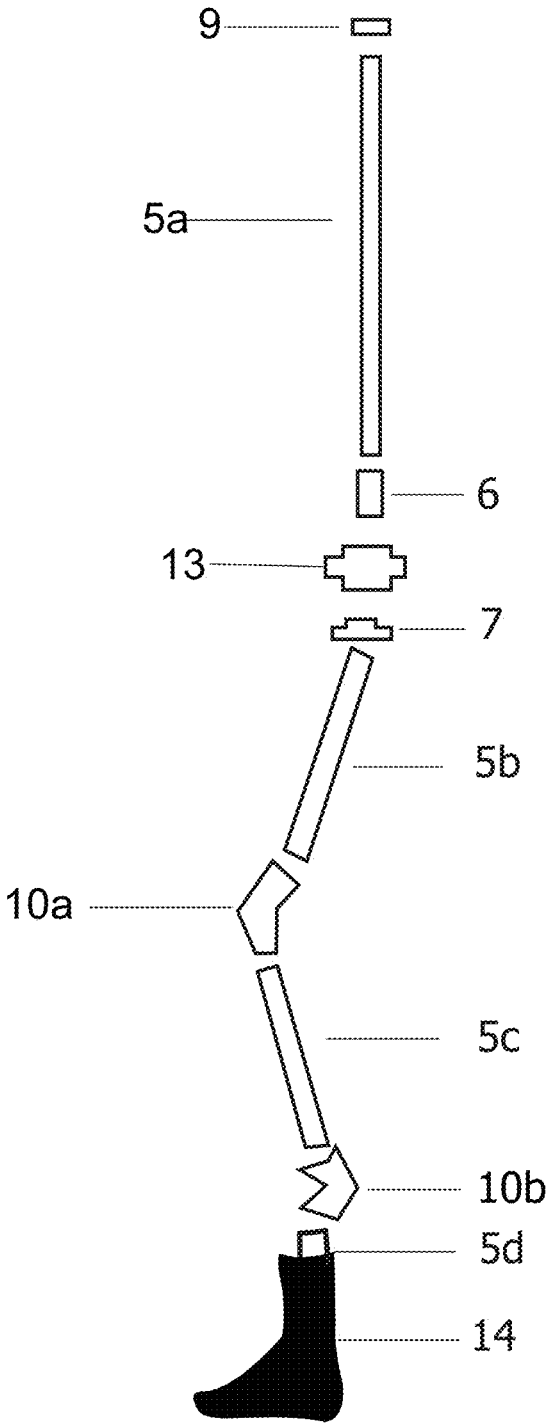
FIG. 1 is an exploded view illustrating connecting relationship of inner training device spine components of an embodiment of the proximity training device with attached training device foot described in the Description of Drawings Section below.
Figure 2:
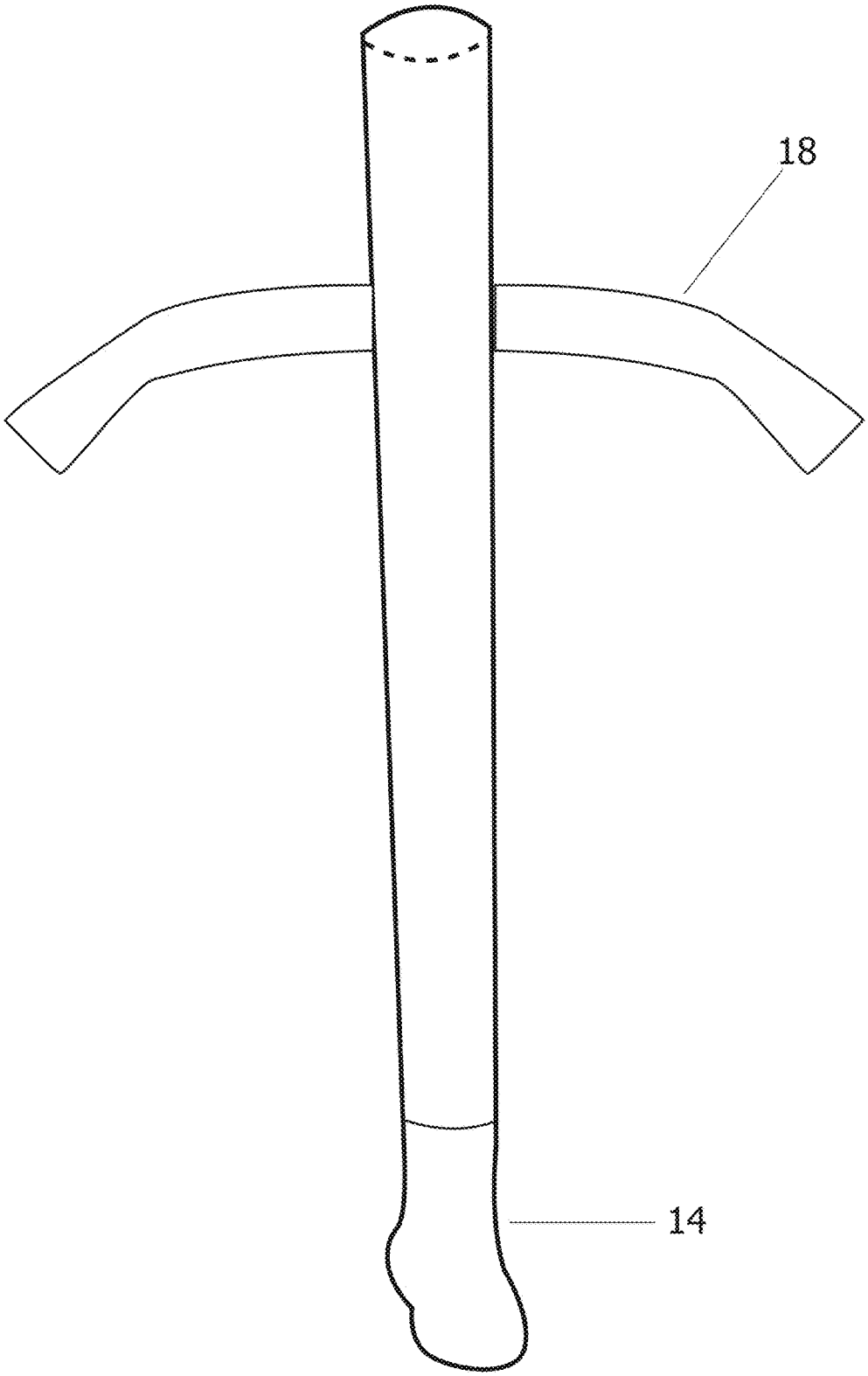
FIG. 2 is a frontal view of the training device, according to the invention, showing a first embodiment training device spine with training device foot (14) attached. Dotted lines are representative of the curvature of the foam noodle training device spine. Training device arms (18) are shown in a position where the arm cover attachments (17) attach the training device arms to the training device spine (not depicted). A view including the collar (19) which would be looped around spine and tied to the spine in the front (19*a*) is not depicted.
Figure 13A:
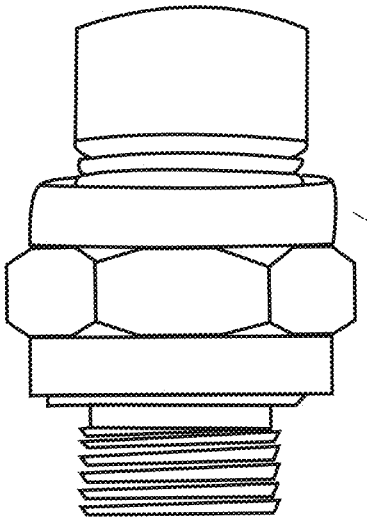
FIG. 13*a* is a perspective view illustrating a swivel ball joint for connecting the plurality of parts.
Figure 13B:
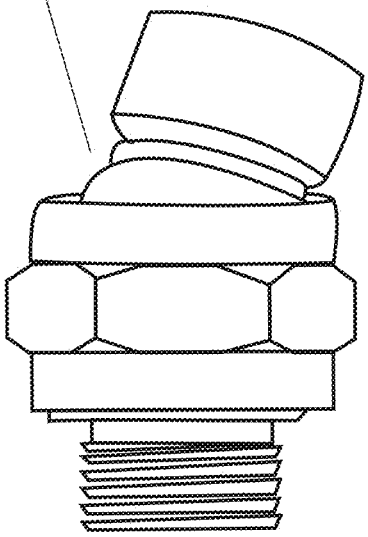
FIG. 13*b* is a perspective view of the swivel ball joint showing rotation of swivel ball.
Figure 14:
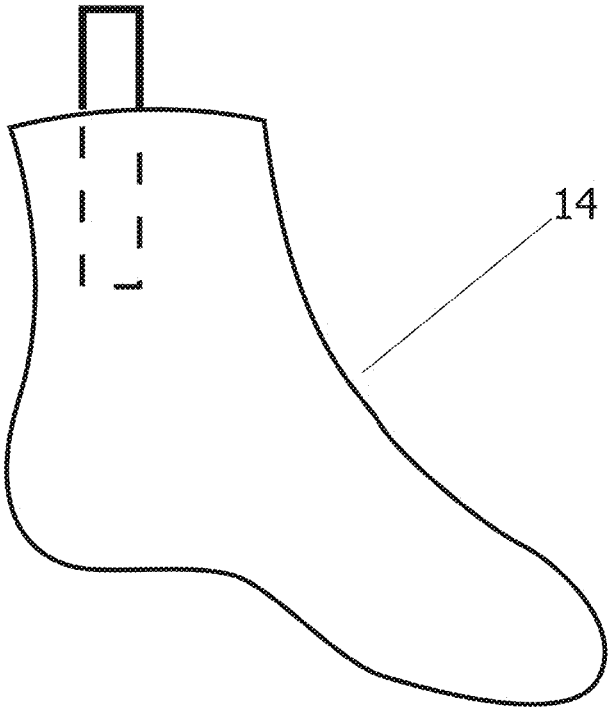
FIG. 14 is a left side view illustrating training device foot according to the invention. Dotted line represents means for connection to training device spine inserted into training device foot.
Figure 15:
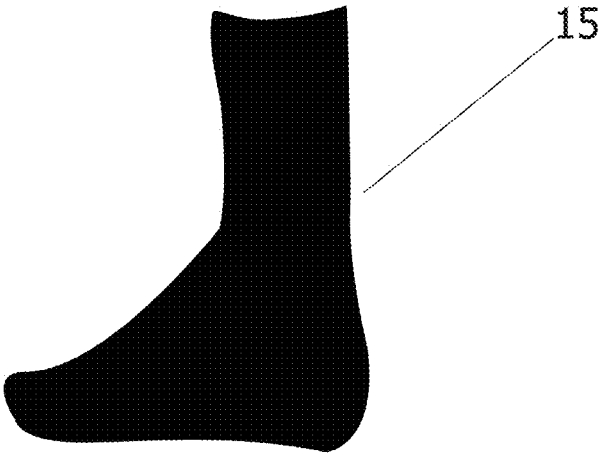
FIG. 15 is a perspective view illustrating a stocking for covering the training device foot.
Figure 16:
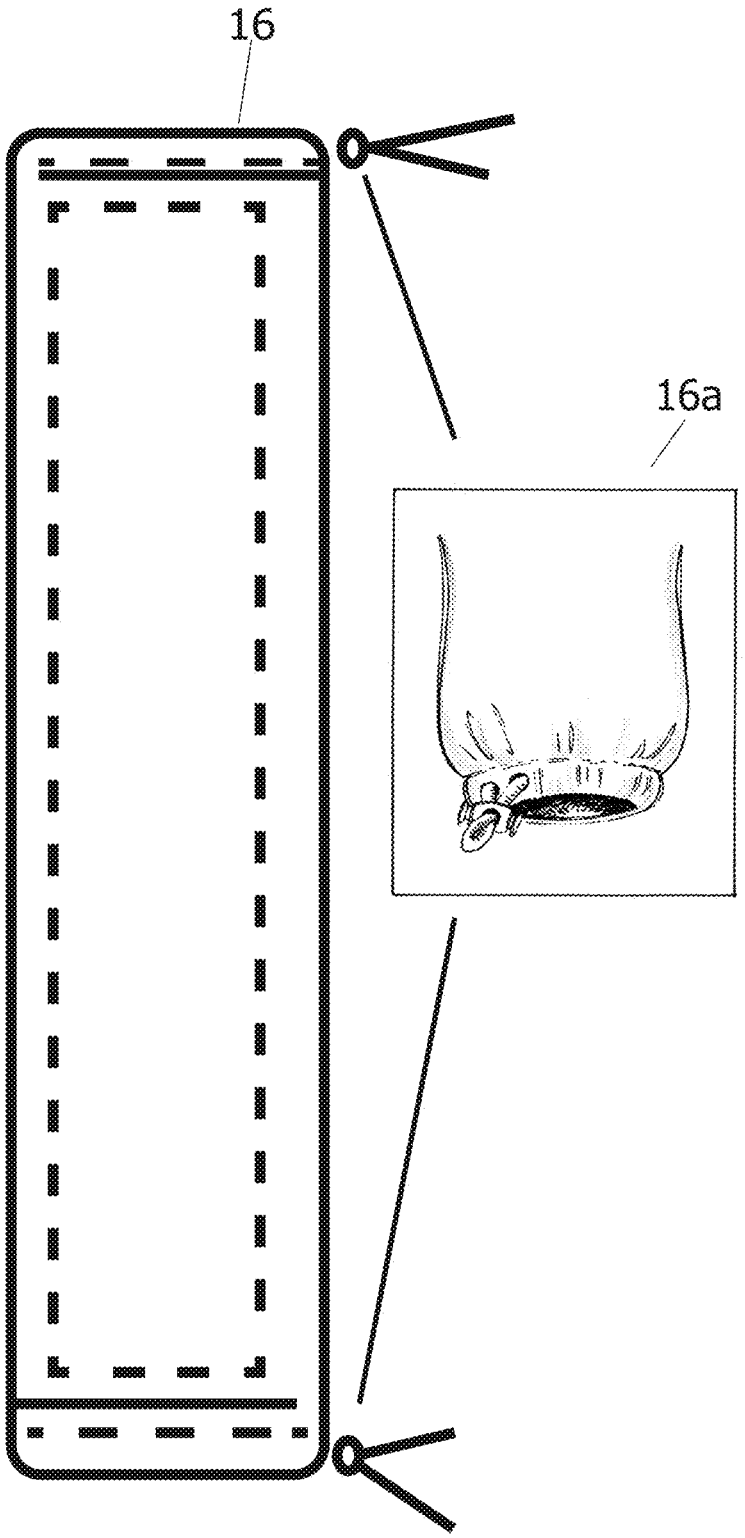
FIG. 16 is a perspective view and close-up view illustrating a fabric tube shaped cover a drawstring closure system for covering the plurality of parts.
Figure 17:
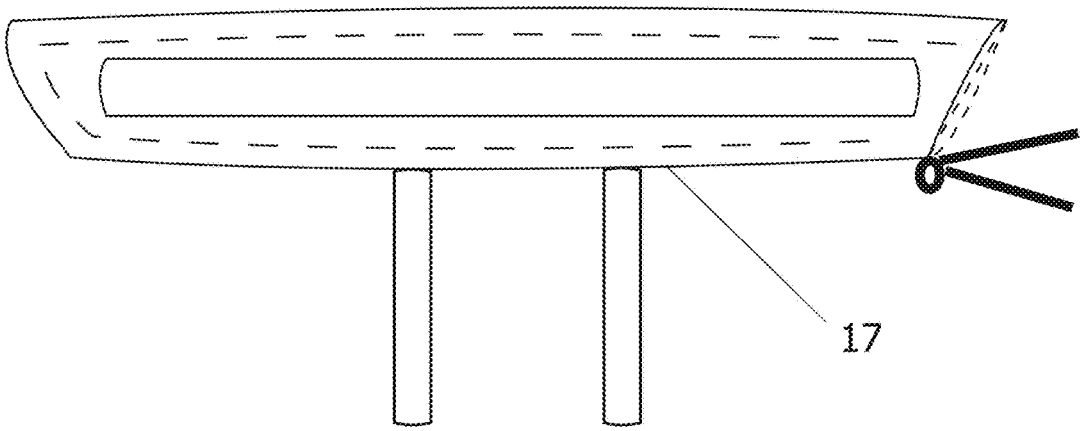
FIG. 17 is a perspective view illustrating a fabric arm cover for attaching the training device arms to the training device spine. The inner solid lines indicate the training device arms inserted into the cover, outer dotted lines represent stitching of cover with one end having a drawstring closure system for securing closure of end of arm cover.
Figure 18:
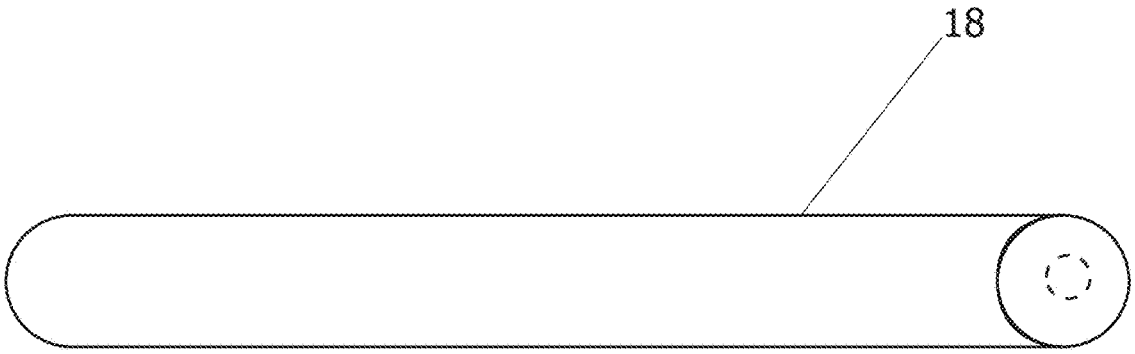
FIG. 18 is a perspective view illustrating the training device arms made from a foam noodle.
Figure 19:
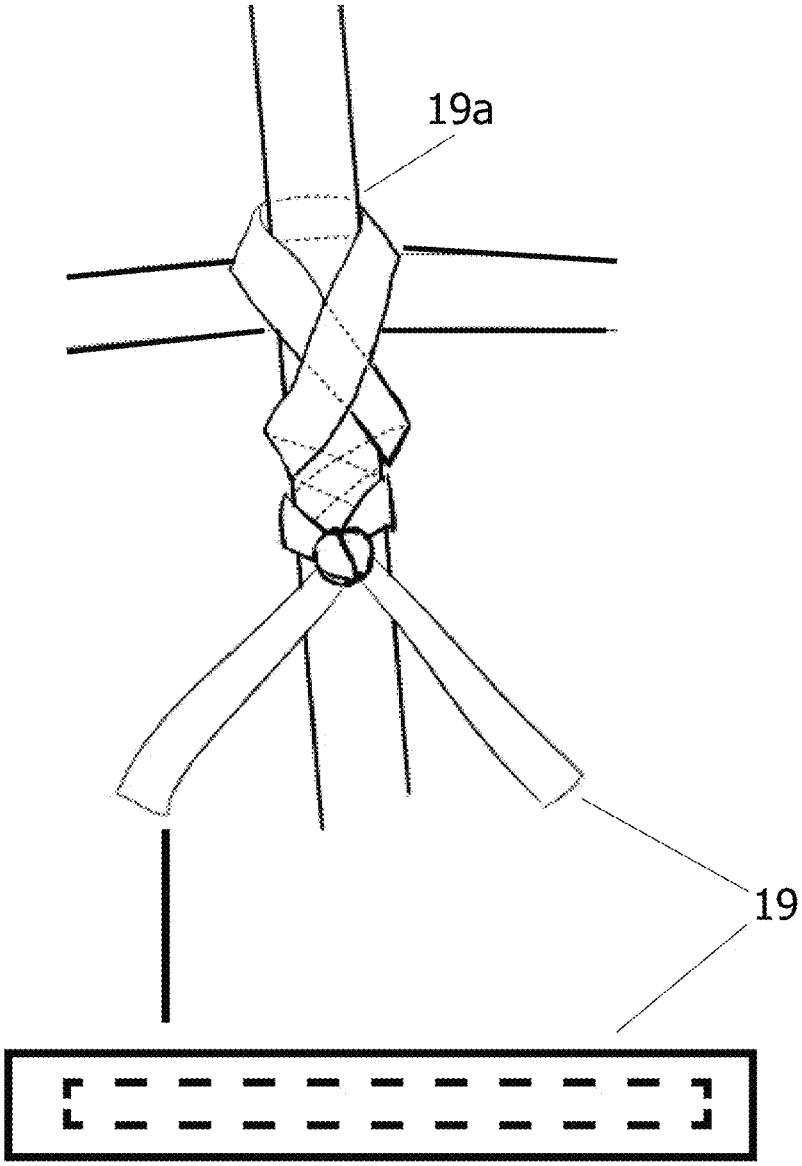
FIG. 19 is a perspective view illustrating a collar for attaching to the training device, the collar being a fabric, tube-shaped cover for controlling and operating said training device.

Referring to FIG. 1, an additional embodiment is realized when means for connection is inserted, as shown in FIG. 1 and detailed in FIGS. 13*a* and 13*b*, illustrating swivel ball joint training device waist. Said training device spine is comprised a cap (9) attached to the top end of a first elongated support member (5*a*) and means for connection to a male-end of swivel ball joint (13) being a female connector (6) attached to the lower end of the first elongated supported member 5*a* of the training device spine as shown in the FIG. 1. Said training device leg depicted in FIG. 1 is comprised of an upper elongated support member (5*b*) with means attached at the top end of the upper elongated support member 5*b* as shown in FIG. 1 being a male connector (7) connecting to female connector of swivel ball joint (13) and having means of connecting to the upper end of the lower elongated support member (5*c*) being comprised of a forty-five degree elbow connector (10*a*) attached to the lower end of the upper elongated support member (5*b*) and connecting it to the upper end of the lower elongated support member (5*c*) which has means being a forty-five degree elbow (10*b*) attached to the lower end of a second lower elongated support member (5*d*) and connecting the training device foot (14) to the lower end of the support member training device leg.

Said training device foot (14) is comprised with means for attachment to the training device spine inserted which includes the second lower elongated length of support member (5*d*), with means for attachment to the training device spine including the following: forty-five degree elbow (10), male or female connector (6 and 7) attached to the length of the second lower elongated support member (5*d*) protruding from training device foot (14) or it may be produced as an elongated support member with the training device leg and training device foot as one piece (not depicted.)

The training device not depicted has a removable cover comprised of a material which is durable and easily cleaned or replaced, preferably constructed of a rip-stop nylon or canvas-type material. The cover (16) is much like a long stocking which fits over the top of the training device spine. The cover is then pulled over the top end of the training device spine and secured by a drawstring closure system (16*a*). The training device arms (18) have a separate arm cover (17) designed for ease of attachment of arms and functions to assist user in guiding and using the training device. The arm covering has means for attachment (17) to the training device spine (FIG. 3) being fabric ties. The foot (14) is covered with a stocking like material such as nylon (15), it is not permanently attached and is easily replaceable. There is a separate collar (19) that loops around the training device spine (19*a*) which functions as supplemental control of the training device by the user (not depicted.)

As shown in 14, the bottom part of the training device is shaped in the form resembling a human foot having a flatter outer edge and conforming to the instep or front of the foot. A curved part having a smaller radius tapering inwardly and outwardly conforming to the transition from the training device foot (14) to the training device spine (FIG. 3) and finally a rounded heel are also provided. In the simulated design of the average human foot the bevel of sourced slope in the ascending part simulates the instep of a human foot. The training device foot is sized to simulate the average human foot for adult, teen and child versions.

Means for attachment and connection of additional weighted material may be placed in the training device foot (14) near the toe area and near the heel area. (Means for attachment not depicted.) Additional weighted material (not depicted) may also be placed in the arm attachment area of the spine. The weighted material may be added in a number of manners, including the following: insertion of weighted material in the tube of the training device spine, insertion of weighted material in training device arms (18.) Weight may also be inserted in the hollow spaces which are not shown in the drawings. The weighted material functions to increase the frictional resistance and the force that may be applied by the user during the execution of a given movement of the preferred user activity.

Said training device has a symmetrical, cylindrically-shaped training device spine (FIG. 3). Said training device offers identical training or exercising possibilities from any side irrespective of its position, which is important particularly for developing the fundamental biomechanical response sequencing of movements associated with the user's chosen activities.

While several embodiments and examples of the invention have been illustrated and described, it is obvious that there are some changes and modifications that may be made thereunto, without departing from the spirit and scope of the claimed invention.

Operation

The components that comprise the training device embodiments, referring to 5, 6, 7, 8, 9, 10, 11, 12 operate and function as an internal stabilizing structure to prevent vertical collapse of the foam noodle (4) when the user engages the training device.

The foam noodle (4) operates and functions as a safety protection to reduce risk of injury if the user falls on it.

The swivel ball joint (13) operates and functions with the rotational capability that an in-person partner might utilize when engaging in the activity. The rotation action is activated at user direction based upon the user's chosen activity.

The training device, shown in FIG. 3, is representative of a completely assembled first embodiment of the proximity training device. This particular embodiment has no special devices that make it function. This first embodiment operates when the user engages the device by gripping the collar (19 and 19*a*) and a sleeve end on the arm cover (17.) Additional gripping configurations can be utilized and are dependent upon the user's goals and the technique they are focusing on developing. The user chooses to hold the training device in the desired proximity for the technique they are focusing on developing. The user chooses to practice from a static position or may choose to move with the training device, which allows the user to focus on posture and timing without the risk of an in-person partner misapplying strength or using inappropriate force, thereby creating a situation where injury is more likely to occur and bad technique ingrained in the user's integration of biomechanical responses. The operation of the training device is completely user-activated.

Means can be attached to allow for suspension of the unit from a frame type structure with rubber bands for repeated speed entry training and possible light resistance training, but is not limited to, such material or structure, the means function to mimic a partner's static proximity to the user providing the user opportunity to develop and hone the fundamental skills necessary for effective, efficient, and safe execution of a chosen technique.

The training device, shown in FIG. 1, is representative of an internal assembly of an embodiment of the proximity training device. This particular embodiment has a swivel ball waist that makes it function with more responsiveness at the user direction.

This embodiment operates when the user engages the device by gripping the collar and a sleeve end on the arm cover. Additional gripping configurations can be utilized and are dependent upon the user's goals and the technique they are focusing on developing. The user chooses to hold the training device in the desired proximity for the technique they are focusing on developing. The user chooses to practice from a static position or may choose to move with the training device, which allows the user to focus on posture and timing while under the stress of knowing an action must occur within a prescribed time or their opportunity to apply a specific technique will be lost, yet without the risk of an in-person partner creating misapplied strength or inappropriate force, thereby creating a situation where injury is more likely to occur and bad technique ingrained in the user's integration of biomechanical responses. The operation of the training device is completely user-activated.

Means can be attached to allow for suspension of the unit from a frame type structure with rubber bands for repeated speed entry training and possible light resistance training, wherein the means function to mimic a partner's static proximity to the user providing the user opportunity to develop and hone the fundamental skills necessary for effective, efficient, and safe execution of a chosen technique.

CONCLUSION, ADDITIONAL RAMIFICATIONS

Advantages

The primary goal for developing the training device was to address the lost training opportunities for practitioners of Judo during times where members of communities are required to remain isolated. However, the device can be utilized for other activities including: dance, patient rehabilitation, teaching students with sensory issues, and physical fitness programs in schools.

The training device invention fills a void in activities that are primarily, and usually practiced in person with an instructor and or a partner, however these activities were disrupted and may possibly be again. Users everywhere are challenged with finding temporary, affordable, and practical solutions to maintaining their ability and access to practice their preferred chosen activities while addressing the issues related to social-distancing recommendations, and health measures implemented for the safety of all. The training device solves this problem, and additional problems that currently exist regarding access to facilities and including other problems not yet facing society on a large scale, but contemplated by the inventor. The problems are solved because the user can continue to practice and develop the foundational biomechanical responses of their chosen activity despite not being able to practice them in person for whatever reason.

The invention relates to a training device for practicing the movements associated with activities that are typically practiced in-person and in some applications with a partner. The settings for the practice of the activities generally have training equipment set-ups or other types of training devices that are specialized and focused toward the goals of the user's preferred chosen activity. The type of equipment found in these settings are generally not appropriate for a home practice setting. Homes were not contemplated for this use by the typical user. If a typical user is required to have the same type of set-up at home in order to continue practice, the expense for modifications would be cost prohibitive. Additionally, many users may have living circumstances where they could not make changes to a property, and would thereby be unable to continue in the activity.

The invention has the advantage of allowing the user to continue practice of their preferred chosen activity by providing a training device that is designed for developing the fundamental biomechanical sequencing connections related to movement skills which are essential for movement-oriented activities, but nevertheless are typically neglected by the average activity enthusiast, and whereby such neglect may lead to injury.

The invention allows for remote instruction, whereby an instructor can view the student and provide real-time feedback on technique while continually stressing safety. The invention allows many activities that have been traditionally practiced in-person with a partner to be practiced by users who are not able to participate in the in-person activity classes for a variety of reasons including, required social distancing efforts, as well as the user's physical location related to availability of local resources for the chosen activity.

The invention addresses issues related to physical fitness options for students in primary and secondary educational settings. An advantage is that generally every student may participate in the activities using the training device with little to no risk of injury, while still increasing fitness levels in a fun and engaging manner. Because the students do not need to touch each other the risk of injury to students is reduced. Additionally this gives school administrators an option for the physical fitness activities that they are able to offer. This would be especially true in regions where bad weather conditions force students to remain indoors. Additionally, liability concerns for school administrators are greatly reduced, and the inclusion of an alternative physical activity may assist with some disciplinary issues faced by school personnel.

It is an additional advantage of the invention to provide a training device for the user to develop proper posture in execution of techniques which is supported by the upright design of the invention as it is employed in practice by the user. Proper posture is transferable to better health of user and overall benefits to the psychological, physical, and emotional health of the user.

The invention has the advantage of providing a training device for developing and encouraging the user to focus on the foundational biomechanical movement responses associated with a user's preferred activity.

The training device is activated by the user engaging the training device and then moving. The training device which is simple in design, lightweight, inexpensive to manufacture, aesthetic, easy to store, and which encourages the exercise of the techniques in a playful, noncompetitive, and non-threatening manner. The soft, rounded material of the training device is designed to reduce risk of injury, even if the user falls on it. The shape and design are safe and fun for all ages. The invention can be utilized by beginner, intermediate, and advanced users, whether they are adults, teens, or children.

The methods and materials described in the claims include some of the methods utilized by the lay person inventors without access to or knowledge of advanced technology or manufacturing processes. The inventors imagine and have visualized that this device could be made efficiently and cost-consciously, if the product is produced in large quantities based on access to proper manufacturing equipment. One method envisioned would allow for the device to be manufactured with the correct amount of rigidity and flexibility, if the unit is produced as a device with four main parts comprised of the training device spine, with arms, legs and cover as separate components. The means for connecting the parts would be embedded into the different components for assembly and disassembly by the user. By manufacturing a device that requires some assembly by the end user, shipping costs would be reduced as the product could be shipped safely in a sturdy mailing bag.

What is claimed is:

1. A proximity training device in the form of a manikin comprising:

a. a training device spine that is elongated and cylindrical in shape, the training device spine comprising a polyethylene foam noodle and a means for stabilizing the polyethylene foam noodle configured to prevent vertical collapse upon engagement by a user;

b. a training device foot comprised of variable-density, self skinning polyurethane expanding foam, the training device foot attached at a lower end of the training device spine through an elongated support member, the elongated support member attached to the lower end of the training device spine through a connector; and c. training device arms comprised of variable density, self-skinning polyurethane expanding foam, and an arm cover system configured to attach the training device arms to the training device spine to allow for adjustment placement of the training device arms on the training device spine.

2. The proximity training device of claim 1, further comprising a training device cover configured to cover at least one of the training device spine and the training device foot.

3. The proximity training device of claim 2, wherein the training device cover is comprised of a durable material.

4. The proximity training device of claim 1, further comprising a collar, wherein the collar is configured to enable a user to control and operate the proximity training device.

5. A proximity training device in the form of a manikin comprising:

a. a training device spine that is elongated and cylindrical in shape, the training device spine comprising a foam noodle and an elongated support member configured to stabilize the foam noodle and prevent vertical collapse upon engagement by a user;

b. a training device foot attached at a lower end of the training device spine through the elongated support member, the elongated support member attached to the lower end of the training device spine through a connector; and c. training device arms, and an arm cover system configured to attach the training device arms to the training device spine to allow for adjustment placement of the training device arms on the training device spine.

6. The proximity training device of claim 5, further comprising a training device cover configured to cover at least one of the training device spine and the training device foot.

7. The proximity training device of claim 6, wherein the training device cover is comprised of a durable material.

8. The proximity training device of claim 5, further comprising a collar, wherein the collar is configured to enable a user to control and operate the proximity training device.

9. The proximity training device of claim 5, wherein the training device foot and the training device arms are comprised of variable-density, self skinning polyurethane expanding foam.

* * * * *